US010688405B2

(12) United States Patent
Moreno

(10) Patent No.: US 10,688,405 B2
(45) Date of Patent: Jun. 23, 2020

(54) LEVITATING BALL ASSEMBLY

(71) Applicant: Cristian Moreno, Jersey City, NJ (US)

(72) Inventor: Cristian Moreno, Jersey City, NJ (US)

( * ) Notice: Subject to any disclaimer, the term of this patent is extended or adjusted under 35 U.S.C. 154(b) by 45 days.

(21) Appl. No.: 16/182,745

(22) Filed: Nov. 7, 2018

(65) Prior Publication Data

US 2020/0139261 A1 May 7, 2020

(51) Int. Cl.
*A63H 33/26* (2006.01)

(52) U.S. Cl.
CPC ..... *A63H 33/26* (2013.01)

(58) Field of Classification Search
USPC ..... 446/131
See application file for complete search history.

(56) References Cited

U.S. PATENT DOCUMENTS 1,176,274 A * 3/1916 Clark ..... A63F 7/0005 273/352
1,825,365 A * 9/1931 Runge ..... F16C 33/422 384/523
D141,522 S * 6/1945 Davidson ..... D21/408
2,400,981 A * 5/1946 Dishmaker ..... A63H 33/00 446/449
3,106,397 A * 10/1963 Lacey ..... A63B 43/04 473/571
3,492,760 A * 2/1970 Nishitani ..... H01F 7/14 446/130
3,686,877 A * 8/1972 Bodin ..... E02D 7/18 405/8
3,706,158 A 12/1972 Jensen
4,042,247 A 8/1977 Harrington
D252,637 S 8/1979 Mackie
4,259,808 A * 4/1981 Oakes ..... A63H 33/26 446/131
4,303,281 A * 12/1981 Irby ..... B23B 31/005 310/90.5
4,964,830 A * 10/1990 Wagner ..... A63H 33/26 335/285
5,072,936 A 12/1991 Warehime
5,313,976 A * 5/1994 Beasley ..... F16K 5/0636 137/15.22
5,503,587 A * 4/1996 Mellen ..... G09B 23/10 248/318
5,584,434 A * 12/1996 Lipson ..... A47G 21/182 239/33
5,893,789 A 4/1999 Wu
6,846,216 B1 1/2005 Balanchi
D513,628 S 1/2006 Andersen
7,048,604 B2 * 5/2006 Cusolito ..... A63H 33/40 273/441
7,601,045 B2 10/2009 Zawitz
(Continued)

FOREIGN PATENT DOCUMENTS

WO WO2006019564 2/2006

*Primary Examiner* — John E Simms, Jr.
*Assistant Examiner* — Dolores R Collins

(57) ABSTRACT

A levitating ball assembly for soothing anxiety in a user includes a cage that can be gripped by a user. A plurality of magnets is each coupled to the cage. A ball is movably positioned in the cage such that the ball freely moves within the cage. The ball is comprised of a magnetized material and the ball has a magnetic polarity that is opposite of a magnetic polarity of each of the magnets. Thus, the ball is levitated in the cage to be manipulated by the user.

7 Claims, 3 Drawing Sheets

(56) References Cited

U.S. PATENT DOCUMENTS

| | | | | |
|---|---|---|---|---|
| D718,005 | S * | 11/2014 | Hansen | D30/160 |
| 8,911,276 | B2 * | 12/2014 | Kim | A63H 33/046 446/92 |
| 8,978,513 | B2 * | 3/2015 | Prober | H02K 7/025 384/603 |
| 9,751,644 | B2 * | 9/2017 | Kim | B64G 1/24 |
| 2005/0043127 | A1 * | 2/2005 | Stephens | A63H 27/00 473/613 |
| 2005/0187423 | A1 | 8/2005 | Ardizzone | |

* cited by examiner

LEVITATING BALL ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to levitating devices and more particularly pertains to a new levitating device for soothing anxiety in a user.

BRIEF SUMMARY OF THE INVENTION

An embodiment of the disclosure meets the needs presented above by generally comprising a cage that can be gripped by a user. A plurality of magnets is each coupled to the cage. A ball is movably positioned in the cage such that the ball freely moves within the cage. The ball is comprised of a magnetized material and the ball has a magnetic polarity that is opposite of a magnetic polarity of each of the magnets. Thus, the ball is levitated in the cage to be manipulated by the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
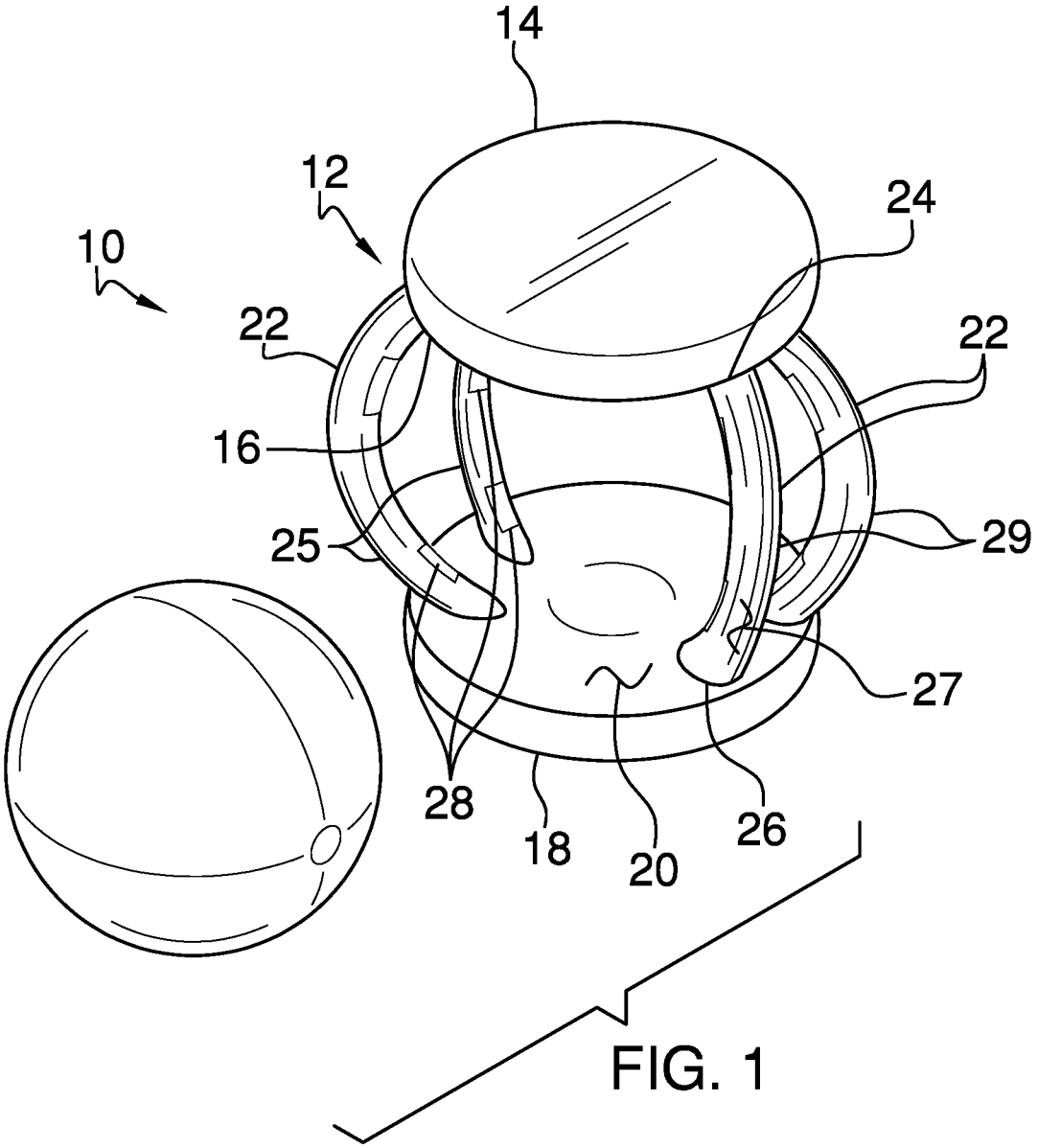
FIG. 1 is a perspective view of a levitating ball assembly according to an embodiment of the disclosure.
Figure 2:
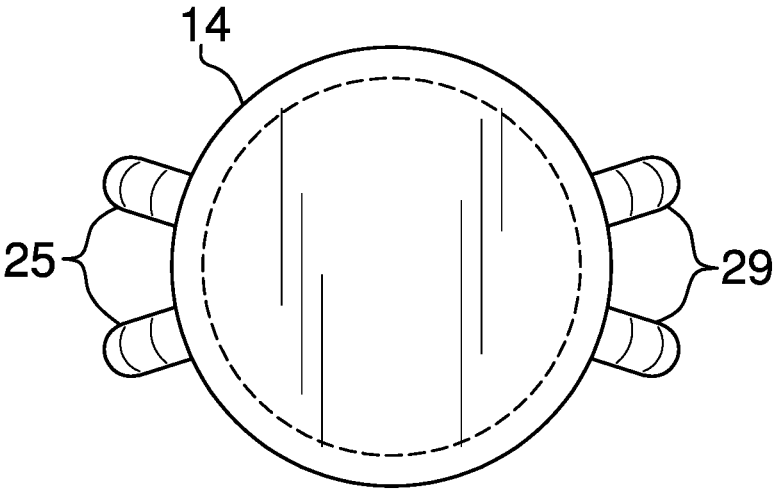
FIG. 2 is a top phantom view of an embodiment of the disclosure.
Figure 3:
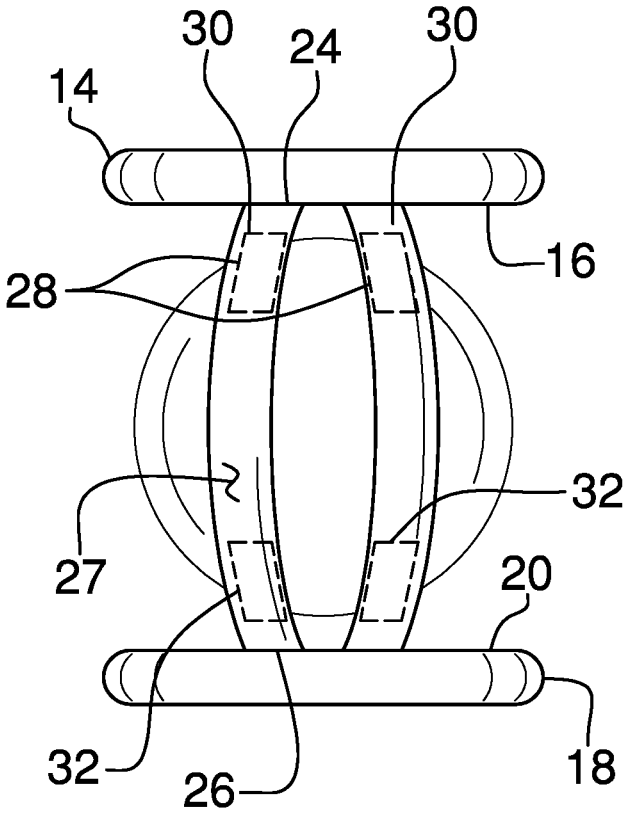
FIG. 3 is a right side phantom view of an embodiment of the disclosure.
Figure 4:
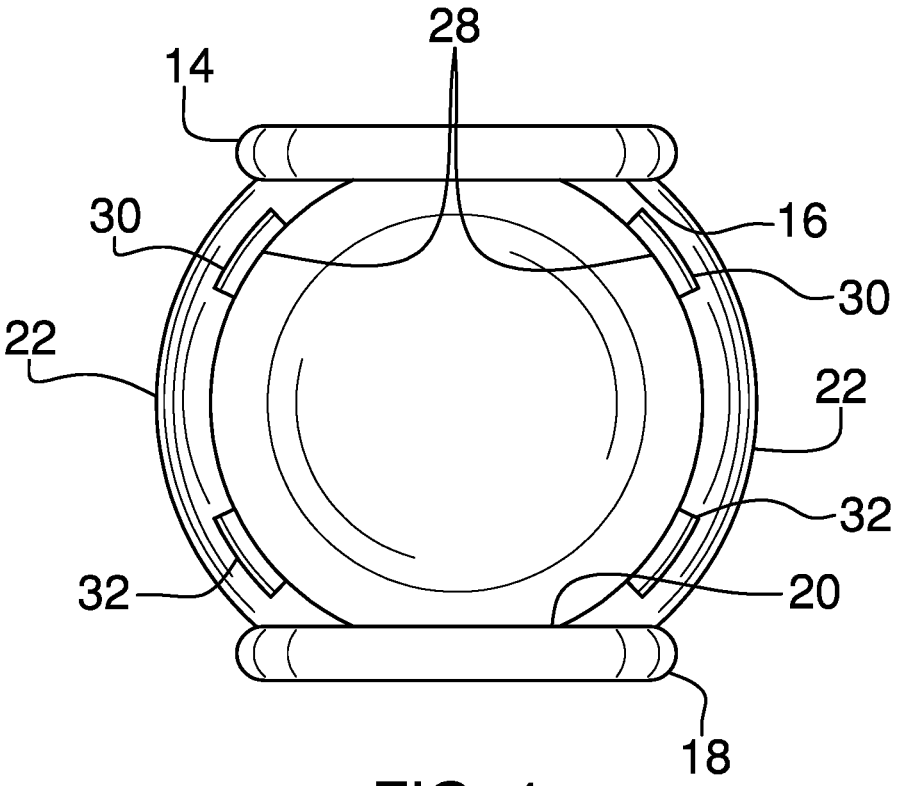
FIG. 4 is a front view of an embodiment of the disclosure.

With reference now to the drawings, and in particular to FIGS. 1 through 4 thereof, a new levitating device embodying the principles and concepts of an embodiment of the disclosure and generally designated by the reference numeral 10 will be described.

As best illustrated in FIGS. 1 through 4, the levitating ball assembly 10 generally comprises a cage 12 that can be gripped by a user. The cage 12 comprises a top disk 14 that has a bottom surface 16, and a bottom disk 18 has a top surface 20. Each of the top 14 and bottom 18 disks may have a length and a width ranging between approximately 2.0 inches and 3.0 inches. The cage 12 includes a plurality of members 22 that each has a first end 24, a second end 26 and an outer surface 27 extending therebetween.

The first end 24 of each of the members 22 is coupled to the bottom surface 16 of the top disk 14 and the second end 26 of each of the members 22 is coupled to the top surface 20 of the bottom disk 18. Moreover, each of the members 22 is curved between the first 24 and second 26 ends. Each of the members 22 is oriented such that each of the members 22 curves outwardly from a center point of the top 14 and bottom 18 disks. The members 22 are spaced apart from each other such that the members 22 defines a spherical shape.

The members are arranged into a first group of members 25 and a second group of members 29. The first group of members 25 are each positioned on opposite sides of the top 14 and bottom 18 disks with respect to the second group of members 29. Additionally, the each of the first group of members 25 is spaced a minimum distance away from each other, each of the second group of members 29 is spaced a minimum distance away from each other. The first group of members 25 are spaced a maximum distance from the second group of members 29.

A plurality of magnets 28 is included and each of the magnets 28 is coupled to the cage 12. Each of the magnets 28 is positioned on the outer surface 27 of a respective one of the members 22 and each of the magnets 28 is directed toward the center point of the top 14 and bottom 18 disks. The plurality of magnets 28 includes a set of first magnets 30 and a set of second magnets 32. Each of the first magnets 30 is positioned closer to the first end 24 than the second end 26 of the respective member 22. Thus, the curvature of the respective member 22 directs each of the first magnets 30 toward the bottom disk 18. Each of the second magnets 32 is positioned closer to the second end 26 than the first end 24 of the respective member 22. Thus, the curvature of the respective member 22 directs each of the second magnets 32 toward the top disk 14.

A ball 34 is movably positioned in the cage 12 such that the ball 34 freely moves within the cage 12. The ball 34 is comprised of a magnetized material and the ball 34 has a magnetic polarity that is opposite of a magnetic polarity of each of the magnets 28. Additionally, each of the first magnets 28 urges the ball 34 downwardly in the cage 12 with a force that is equal to a force with which each of the second magnets 28 urges the ball 34 upwardly in the cage 12. In this way the ball 34 is levitated in the cage 12 to be manipulated by the user. The ball 34 may be removable from the cage 12 by passing the ball 34 between the first group of members 25 and the second group of members 29.

In use, each of the top 14 and bottom 18 disks is gripped with a respective thumb and index finger. The ball 34 is spun or otherwise manipulated while the cage 12 is gripped. Thus, the ball 34 relaxes tension in the user or soothes anxiety in the user. The cage 12 can be rested on a support surface such as a table or the like while the ball 34 is manipulated. Additionally, the cage 12 can be displayed with the ball 34 levitating motionless in the cage 12 for a pleasing visual effect.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A levitating ball assembly being configured to be manipulated by a user for pleasure, said assembly comprising:

a cage being gripped by a user;

a plurality of magnets, each of said magnets being coupled to said cage;

a ball being movably positioned in said cage such that said ball freely moves within said cage, said ball being comprised of a magnetized material, said ball having a magnetic polarity being opposite of a magnetic polarity of each of said magnets such that said ball is levitated in said cage wherein said ball is configured to be manipulated by the user.

2. The assembly according to claim 1, wherein said cage comprises:

a top disk having a bottom surface;

a bottom disk having a top surface; and a plurality of members, each of said members having a first end, a second end and an outer surface extending therebetween, said first end of each of said members being coupled to said bottom surface of said top disk, said second end of each of said members being coupled top said top surface of said bottom disk.

3. The assembly according to claim 2, wherein each of said members is curved between said first and second ends, each of said members being oriented such that each of said members curves outwardly from a center point of said top and bottom disks, said members being spaced apart from each other such that said members defines a spherical shape.

4. The assembly according to claim 2, wherein said plurality of magnets includes a set of first magnets and a set of second magnets, each of said first magnets being positioned closer to said first end than said second end of said respective member, each of said second magnets being positioned closer to said second end than said first end of said respective member.

5. The assembly according to claim 3, wherein each of said magnets is positioned on said outer surface of a respective one of said members, each of said magnets being directed toward said center point of said top and bottom disks.

6. The assembly according to claim 4, wherein each of said first magnets urges said ball downwardly in said cage with a force being equal to a force with which each of said second magnets urges said ball upwardly in said cage.

7. A levitating ball assembly being configured to be manipulated by a user for pleasure, said assembly comprising:

a cage being gripped by a user, said cage comprising:

a top disk having a bottom surface;

a bottom disk having a top surface; and a plurality of members, each of said members having a first end, a second end and an outer surface extending therebetween, said first end of each of said members being coupled to said bottom surface of said top disk, said second end of each of said members being coupled top said top surface of said bottom disk, each of said members being curved between said first and second ends, each of said members being oriented such that each of said members curves outwardly from a center point of said top and bottom disks, said members being spaced apart from each other such that said members defines a spherical shape;

a plurality of magnets, each of said magnets being coupled to said cage, each of said magnets being positioned on said outer surface of a respective one of said members, each of said magnets being directed toward said center point of said top and bottom disks, said plurality of magnets including a set of first magnets and a set of second magnets, each of said first magnets being positioned closer to said first end than said second end of said respective member, each of said second magnets being positioned closer to said second end than said first end of said respective member; and a ball being movably positioned in said cage such that said ball freely moves within said cage, said ball being comprised of a magnetized material, said ball having a magnetic polarity being opposite of a magnetic polarity of each of said magnets such that said ball is levitated in said cage wherein said ball is configured to be manipulated by the user, each of said first magnets urging said ball downwardly in said cage with a force being equal to a force with which each of said second magnets urges said ball upwardly in said cage.

* * * * *